United States Patent [19]

Chen et al.

[11] Patent Number: 4,969,192

[45] Date of Patent: Nov. 6, 1990

[54] VECTOR ADAPTIVE PREDICTIVE CODER FOR SPEECH AND AUDIO

[75] Inventors: Juin-Hwey Chen, Canton, Mass.; Allen Gersho, Goleta, Calif.

[73] Assignee: Voicecraft, Inc., Goleta, Ga.

[21] Appl. No.: 35,615

[22] Filed: Apr. 6, 1987

[51] Int. Cl.[5] ..... G10L 7/02

[52] U.S. Cl. ..... 381/31

[58] Field of Search ..... 381/29-32, 381/36-41, 51; 375/122, 25-34

[56] References Cited

U.S. PATENT DOCUMENTS

| | | | |
|---|---|---|---|
| 4,472,832 | 9/1984 | Atal et al. | 381/40 |
| 4,475,227 | 10/1984 | Belfield | 381/30 |
| 4,617,677 | 10/1986 | Jayant et al. | 375/27 |
| 4,720,861 | 1/1988 | Bertrand | 381/36 |
| 4,726,037 | 2/1988 | Jayant | 381/30 |
| 4,757,517 | 7/1988 | Yatsuzuka | 375/25 |
| 4,868,867 | 9/1989 | Davidson et al. | 381/36 |

OTHER PUBLICATIONS

Linde, et al., "An Algorithm for Vector Quantizer Design", IEEE Transactions on Communications, vol. Com-28, No.1, Jan. 1980.

Flanagan, et al., "Speech Coding", IEEE Transactions on Communications, vol. Com-27, No. 4, Apr. 1979.

M. R. Schroeder and B. S. Atal, "Code-Excited Linear Prediction (CELP): High-Quality Speech at Very Low Bit Rates", Proc. Int'l. Conf. Acoustics, Speech, Signal Proc., Tampa, Mar. 1985.

Manfred R. Schroeder, "Predictive Coding of Speech: Historical Review and Directions for Future Research", ICASSP 86, Tokyo.

Trancoso, et al., "Efficient Procedures for Finding the Optimum Innovation in Stochastic Coders", ICASSP 86, Tokyo.

N. S. Jayant and P. Noll, "Digital Coding of Waveforms", Prentice-Hall Inc., Englewood Cliffs, N.J., 1984.

J. Makhoul, S. Roucos and H. Gish, "Vector Quantization in Speech Coding", Proc. IEEE, vol. 73, No. 11, Nov. 1985.

T. Berger, "Rate Distortion Theory", Prentice-Hall Inc., Englewood Cliffs, N.J., pp. 147-151, 1971.

B. S. Atal and M. R. Schroeder, "Adaptive Predictive Coding of Speech Signals", Bell Syst. Tech. J., vol. 49, pp. 1973-1986, Oct. 1970.

B. S. Atal and M. R. Schroeder, "Predictive Coding of Speech Signals and Subjective Error Criteria", IEEE Trans. Acoust., Speech, Signal Proc., vol. ASSP-27, No. 3, pp. 247-254, Jun. 1979.

B. S. Atal, "Predictive Coding of Speech at Low Bit Rates", IEEE Trans. Comm., vol. COM-30, No. 4, Apr. 1982.

(List continued on next page.)

*Primary Examiner*—Gary V. Harkcom
*Assistant Examiner*—John A. Merecki
*Attorney, Agent, or Firm*—Antonio M. Fernandez

[57] ABSTRACT

A real-time vector adaptive predictive coder which approximates each vector of K speech samples by using each of M fixed vectors in a first codebook to excite a time-varying synthesis filter and picking the vector that minimizes distortion. Predictive analysis for each frame determines parameters used for computing from vectors in the first codebook zero-state response vectors that are stored at the same address (index) in a second codebook. Encoding of input speech vectors $s_n$ is then carried out using the second codebook. When the vector that minimizes distortion is found, its index is transmitted to a decoder which has a codebook identical to the first codebook of the decoder. There the index is used to read out a vector that is used to synthesize an output speech vector $\hat{s}_n$. The parameters used in the encoder are quantized, for example by using a table, and the indices are transmitted to the decoder where they are decoded to specify transfer characteristics of filters used in producing the vector $\hat{s}_n$ from the receiver codebook vector selected by the vector index transmitted.

12 Claims, 5 Drawing Sheets

OTHER PUBLICATIONS

V. Cuperman and A. Gersho, "Vector Predictive Coding of Speech at 16 kb/s", IEEE Trans. Comm., vol. Com-33, pp. 685-696, Jul. 1985.

M. R. Schroeder, B. S. Atal and J. L. Hall, "Optimizing Digital Speech Coders by Exploiting Masking Properties of the Human Ear", J. Acoust. Soc. Am., vol. 66, No. 6, pp. 1647-1652.

J. L. Flanagan, *Speech Analysis, Synthesis, and Perception,* Academic Press, pp. 367-370, New York 1972.

V. Ramamoorthy and N. S. Jayant, "Enhancement of ADPCM Speech by Adaptive Postfiltering", AT&T Bell Labs Tech. J., pp. 1465-1475, Oct. 1984.

N. S. Jayant and V. Ramamoorthy, "Adaptive Postfiltering of 16 kb/s-ADPCM Speech", Proc. ICASSP, pp. 829-832, Tokyo, Japan, Apr. 1986.

VECTOR ADAPTIVE PREDICTIVE CODER FOR SPEECH AND AUDIO

ORIGIN OF INVENTION

The invention described herein was made in the performance of work under a NASA contract, and is subject to the provisions of Public Law 96-517 (35 USC 202) under which the inventors were granted a request to retain title.

BACKGROUND OF THE INVENTION

This invention relates a real-time coder for compression of digitally encoded speech or audio signals for transmission or storage, and more particularly to a real-time vector adaptive predictive coding system.

In the past few years, most research in speech coding has focused on bit rates from 16 kb/s down to 150 bits/s. At the high end of this range, it is generally accepted that toll quality can be achieved at 16 kb/s by sophisticated waveform coders which are based on scalar quantization. N. S. Jayant and P. Noll, *Digital Coding of Waveforms,* Prentice-Hall Inc., Englewood Cliffs, N.J., 1984. At the other end, coders (such as linear-predictive coders) operating at 2400 bits/s or below only give syntheticquality speech. For bit rates between these two extremes, particularly between 4.8 kb/s and 9.6 kb/s, neither type of coder can achieve high-quality speech. Part of the reason is that scalar quantization tends to break down at a bit rate of 1 bit/sample. Vector quantization (VQ), through its theoretical optimality and its capability of operating at a fraction of one bit per sample, offers the potential of achieving high-quality speech at 9.6 kb/s or even at 4.8 kb/s. J. Makhoul, S. Roucos, and H. Gish, "Vector Quantization in Speech Coding," Proc. IEEE, Vol. 73, No. 11, November 1985.

Vector quantization (VQ) can achieve a performance arbitrarily close to the ultimate rate-distortion bound if the vector dimension is large enough. T. Berger, *Rate Distortion Theory,* Prentice-Hall Inc., Englewood Cliffs, N.J., 1971. However, only small vector dimensions can be used in practical systems due to complexity considerations, and unfortunately, direct waveform VQ using small dimensions does not give adequate performance. One possible way to improve the performance is to combine VQ with other data compression techniques which have been used successfully in scalar coding schemes.

In speech coding below 16 kb/s, one of the most successful scalar coding schemes is Adaptive Predictive Coding (APC) developed by Atal and Schroeder [B. S. Atal and M. R. Schroeder, "Adaptive Predictive Coding of Speech Signals," Bell Syst. Tech. J., Vol. 49, pp. 1973–1986, October 1970; B. S. Atal and M. R. Schroeder, "Predictive Coding of Speech Signals and Subjective Error Criteria," IEEE Trans. Acoust., Speech, Signal Proc., Vol. ASSP-27, No. 3, June 1979: and B. S. Atal, "Predictive Coding of Speech at Low Bit Rates," IEEE Trans. Comm., Vol. COM-30, No. 4, April 1982]. It is the combined power of VQ and APC that led to the development of the present invention, a Vector Adaptive Predictive Coder (VAPC). Such a combination of VQ and APC will provide high-quality speech at bit rates between 4.8 and 9.6 kb/s, thus bridging the gap between scalar coders and VQ coders.

The basic idea of APC is to first remove the redundancy in speech waveforms using adaptive linear predictors, and then quantize the prediction residual using a scalar quantizer. In VAPC, the scalar quantizer in APC is replaced by a vector quantizer VQ. The motivation for using VQ is two-fold. First, although liner dependency between adjacent speech samples is essentially removed by linear prediction, adjacent prediction residual samples may still have nonlinear dependency which can be exploited by VQ. Secondly, VQ can operate at rates below one bit per sample. This is not achievable by scalar quantization, but it is essential for speech coding at low bit rates.

The vector adaptive predictive coder (VAPC) has evolved from APC and the vector predictive coder introduced by V. Cuperman and A. Gersho, "Vector Predictive Coding of Speech at 16 kb/s," IEEE Trans. Comm., Vol. COM-33, pp. 685–696, July 1985. VAPC contains some features that are somewhat similar to the Code-Excited Linear Prediction (CELP) coder by M. R. Schroeder, B. S. Atal, "Code-Excited Linear Prediction (CELP): High-Quality Speech at Very Low Bit Rates," Proc. Int'l. Conf. Acoustics, Speech, Signal Proc., Tampa, March 1985, but with much less computational complexity.

In computer simulations, VAPC gives very good speech quality at 9.6 kb/s, achieving 18 dB of signal-to-noise ratio (SNR) and 16 dB of segmental SNR. At 4.8 kb/s, VAPC also achieves reasonably good speech quality, and the SNR and segmental SNR are about 13 dB and 11.5 dB, respectively. The computations required to achieve these results are only in the order of 2 to 4 million flops per second (one flop, a floating point operation, is defined as one multiplication, one addition, plus the associated indexing), well within the capability of today's advanced digital signaling processor chips. VAPC may become a low-complexity alternative to CELP, which is known to have achieved excellent speech quality at an expected bit rate around 4.8 kb/s but is not presently capable of being implemented in real-time due to its astronomical complexity. It requires over 400 million flops per second to implement the coder. In terms of the CPU time of a supercomputer CRAY-1, CELP requires 125 seconds of CPU time to encode one second of speech. There is currently a great need for a real-time, high-quality speech coder operating at encoding rates ranging from 4.8 to 9.6 kb/s. In this range of encoding rates, the two coders mentioned above (APC and CELP) are either unable to achieve high quality or too complex to implement. In contrast, the present invention, which combines Vector Quantization (VQ) with the advantages of both APC and CELP, is able to achieve high-quality speech with sufficiently low complexity for real-time coding.

OBJECTS AND SUMMARY OF THE INVENTION

An object of this invention is to encode in real time analog speech or audio waveforms into a compressed bit stream for storage and/or transmission, and subsequent reconstruction of the waveform for reproduction.

Another object is to provide adaptive post-filtering of a speech or audio signal that has been corrupted by noise resulting from a coding system or other sources of degradation so as to enhance the perceived quality of said speech or audio signal.

The objects of this invention are achieved by a system which approximates each vector of K speech samples by using each of M fixed vectors stored in a VQ codebook to excite a time-varying synthesis filter and picking the best synthesized vector that minimizes a perceptually meaningful distortion measure. The original sampled speech is first buffered and partitioned into vectors and frames of vectors, where each frame is partitioned into N vectors, each vector having K speech samples. Predictive analysis of pitch-filtering parameters (P) linear-predictive coefficient filtering parameters (LPC), perceptual weighting filter parameters (W) and residual gain scaling factor (G) for each of successive frames of speech is then performed. The parameters determined in the analyses are quantized and reset every frame for processing each input vector $s_n$ in the frame, except the perceptual weighting parameter. A perceptual weighting filter responsive to the parameters W is used to help select the VQ vector that minimizes the perceptual distortion between the coded speech and the original speech. Although not quantized, the perceptual weighting filter parameters are also reset every frame.

After each frame is buffered and the above analysis is completed at the beginning of each frame, M zero-state response vectors are computed and stored in a zero-state response codebook. These M zero-state response vectors are obtained by first setting to zero the memory of an LPC synthesis filter and a perceptual weighting filter in cascade with a scaling unit controlled by the factor G, and then controlling the respective filters with the quantized LPC filter parameters and the unquantized perceptual weighting filter parameters, and exciting the cascaded filters using one predetermined and fixed vector quantization (VQ) codebook vector at a time. The output vector of the cascaded filters for each VQ codebook vector is then store in a temporary zero-state codebook at the corresponding address, i.e., is assigned the same index of a temporary zero-state response codebook as the index of the exciting vector out of the VQ codebook. In encoding each in each vector $s_n$ within a frame, a pitch-predicted vector $\hat{s}_n$ the vector $s_n$ is determined by processing the last vector encoded as an index code through a scaling unit, LPC synthesis filter and pitch predictor filter controlled by the parameters QG, QLPC, QP and QPP for the frame. In addition, the zero-input response of the cascaded filters (the ringing from excitation of a previous vector) is first set in a zero-input response filter. Once the pitch-predicted vector $\hat{s}_n$ is subtracted from the input signal vector $s_n$, and a difference vector $d_n$ is passed through the perceptual weighting filter to produce a filtered difference vector $f_n$, the zero-input response vector in the aforesaid zero-input response filter is subtracted from the output of the perceptual weight filter, namely the difference vector $f_n$, and the resulting vector $v_n$ is compared with each of the M stored zero-state response vectors in search of the one having a minimum difference $\Delta$ or distortion.

The index (address) of the zero-state response vector that produces the smallest distortion, i.e., that is closest to $v_n$, identifies the best vector in the permanent VQ codebook. Its index (address) is transmitted as the vector compressed code for the vector $s_n$, and used by a receiver which has an identical VQ codebook as the transmitter to find the best-match vector. In the transmitter, that best-match vector is used at the time of transmission of its index to excite the LPC synthesis filter and pitch prediction filter to generate an estimate $\hat{s}_n$ of the next speech vector. The best-match vector is also used to excite the zero-input response filter to set it for the next input vector $s_n$ to be processed as described above. The indices of the best-match vectors for a frame of vectors are combined in a multiplexer with the frame analysis information hereinafter referred to as "side information," comprised of the indices of quantized parameters which control pitch, pitch predictor and LPC predictor filtering and the gain used in the coding process, in order that it be used by the receiver in decoding the vector indices of a frame into vectors using a codebook identical to the permanent VQ codebook at the transmitter. This side information is preferably transmitted through the multiplexer first, once for each frame of VQ indices that follow, but it would be possible to first transmit a frame of vector indices, and then transmit the side information since the frames of vector indices will require some buffering in either case; the difference is only in some initial delay at the beginning of speech or audio frames transmitted in succession. The resulting stream of multiplexed indices are transmitted over a communication channel to a decoder, or stored for later decoding.

In the decoder, the bit stream is first demultiplexed to separate the side information from the encoded vector indices that follow. Each encoded vector index is used at the receiver to extract the corresponding vector from the duplicate VQ codebook. The extracted vector is first scaled by the gain parameter, using a table to convert the quantized gain index to the appropriate scaling factor, and then used to excite cascaded LPC synthesis and pitch synthesis filters controlled by the same side information used in selecting the best-match index utilizing the zero-state response codebook in the transmitter. The output of the pitch synthesis filter is the coded speech, which is perceptually close to the original speech. All of the side information, except the gain information, is used in an adaptive postfilter to enhance the quality of the speech synthesized. This postfiltering technique may be used to enhance any voice or audio signal. All that would be required is an analysis section to produce the parameters used to make the postfilter adaptive.

Other modifications and variation to this invention may occur to those skilled in the art, such as variable-frame-rate coding, fast codebook searching, reversal of the order of pitch prediction and LPC prediction, and use of alternative perceptual weighting techniques. Consequently, the claims which define the present invention are intended to encompass such modifications and variations.

Although the purpose of this invention is to encode for transmission and/or storage of analog speech or audio waveforms for subsequent reconstruction of the waveforms upon reproduction of the speech or audio program, reference is made hereinafter only to speech, but the invention described and claimed is applicable to audio waveforms or to sub-band filtered speech or audio waveforms.

DESCRIPTION OF PREFERRED EMBODIMENTS

Figure 1A:
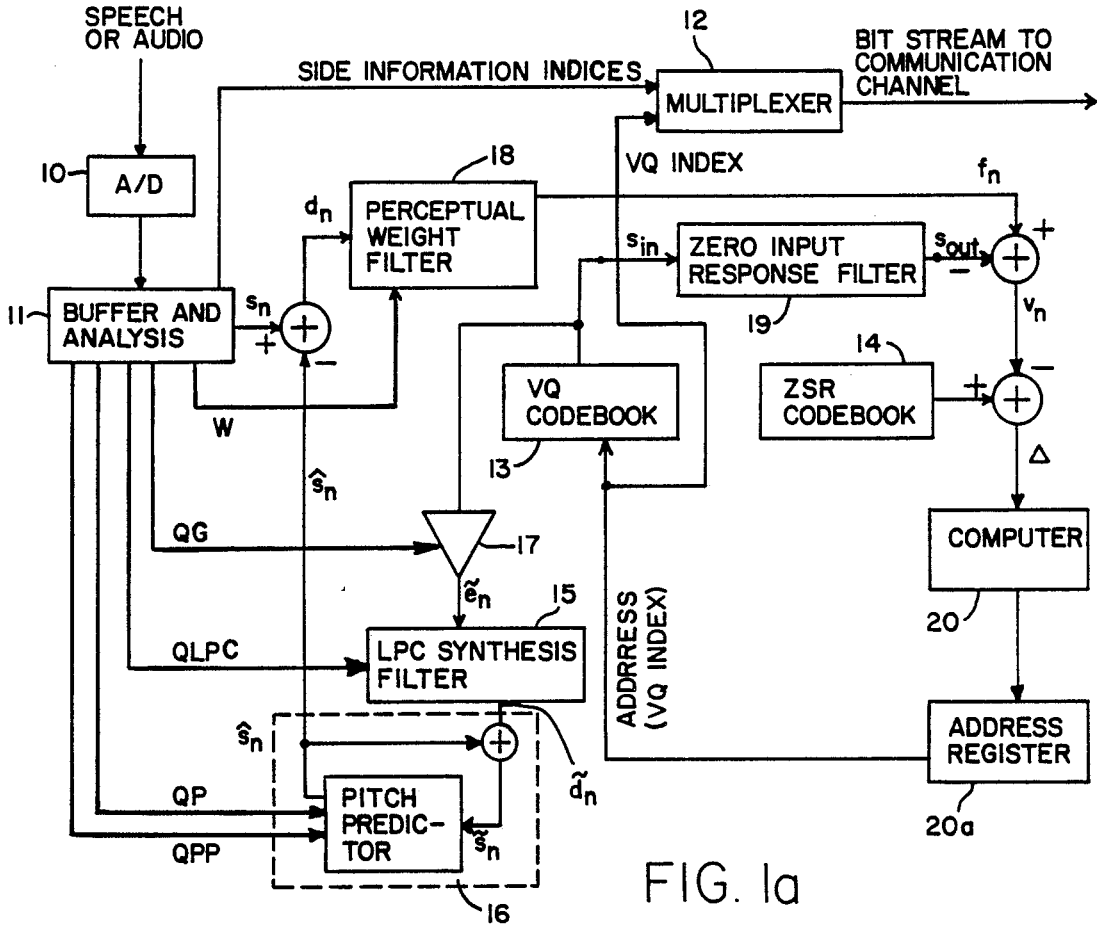
FIG. 1*a* is a block diagram of a Vector Adaptive Predictive Coding (VAPC) processor embodying the present invention.

The preferred mode of implementation contemplates using programmable digital signal processing chips, such as one or two AT&T DSP32 chips, and auxiliary chips for the necessary memory and controllers for such equipments as input sampling, buffering and multiplexing. Since the system is digital, it is synchronized throughout with the samples. For simplicity of illustration and explanation, the synchronizing logic is not shown in the drawings. Also for simplification, at each point where a signal vector is subtracted from another, the subtraction function is symbolically indicated by an adder represented by a plus sign within a circle. The vector being subtracted is on the input labeled with a minus sign. In practice, the two's complement of the subtrahend is formed and added to the minuend. However, although the preferred implementation contemplates programmable digital signal processors, it would be possible to design and fabricate special integrated circuits using VLSI techniques to implement the present invention as a special purpose, dedicated digital signal processor once the quantities needed would justify the initial cost of design.

Referring to FIG. 1*a*, original speech samples in digital form from sampling analog-to-digital converter 10 are received by an analysis processor 11 which partitions them into vectors $s_n$ of K samples per vector, and into frames of N vectors per frame. The analysis processor stores the samples in a dual buffer memory which has the capacity for storing more than one frame of vectors, for example two frames of 8 vectors per frame, each vector consisting of 20 samples, so that the analysis processor may compute parameters used for coding the stored frame. As each frame is being processed out of one buffer, a new frame coming in is stored in the other buffer so that when processing of a frame has been completed, there is a new frame buffered and ready to be processed.

The analysis processor 11 determines the parameters of filters employed in the Vector Adaptive Predictive Code (VAPC) technique that is the subject of this invention. These parameters are transmitted through a multiplexer 12 as side information just ahead of the frame of vector codes generated with the use of a permanent vector quantized (VQ) codebook 13 and a zero-state response (ZSR) codebook 14. The side information conditions the receiver to properly filter decoded vectors of the frame. The analysis processor 11 also computes other parameters used in the encoding process. The latter are represented in FIG. 1*a* by labeled lines, and consist of sets of parameters which are designated W for a perceptual weighting filter 18, a quantized LPC predictor QLPC for an LPC synthesis filter 15, and quantized pitch QP and pitch predictor QPP for a pitch synthesis filter 16. Also computed by the analysis processor is a scaling factor G that is quantized to AG for control of a scaling unit 17. The four quantized parameters transmitted as side information are encoded for transmission using a quantizing table as the quantized pitch index, pitch predictor index, LPC predictor index and gain index. The manner in which the analysis processor computes all of these parameters will be described with reference to FIG. 3.

Figure 2:
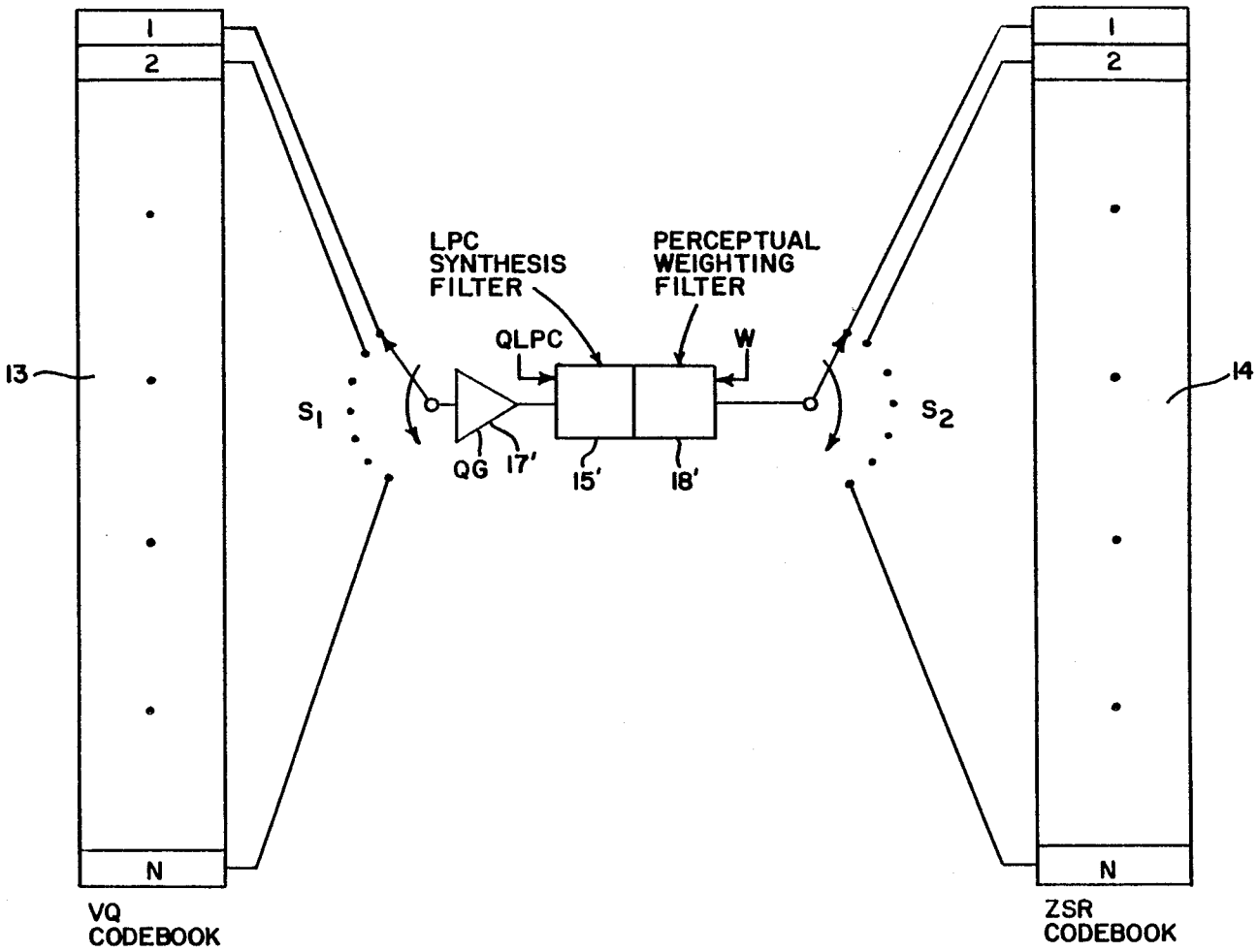
FIG. 2 is a schematic diagram that illustrates the adaptive computation of vectors for a zero-state response codebook in the system of FIG. 1*a*.

The multiplexer 12 preferably transmits the side information as soon as it is available, although it could follow the frame of encoded input vectors, and while that is being done, M zero-state response vectors are computed for the zero-state response (ZSR) codebook 14 in a manner illustrated in FIG. 2, which is to process each vector in the VQ codebook, 13 e.g., 128 vectors, through a gain scaling unit 17', an LPC synthesis filter 15', and perceptual weighting filters 18' corresponding to the gain scaling unit 17, the LPC synthesis filter 15, and perceptual weighting filter 18 in the transmitter (FIG. 1*a*). Ganged commutating switches $S_1$ and $S_2$ are shown to signify that each fixed VQ vector processed is stored in memory locations of the same index (address) in the ZSR codebook.

At the beginning of each codebook vector processing, the initial conditions of the cascaded filters 15' and 18' are set to zero. This simulates what the cascaded filters 15' and 18' will do with no previous vector present from its corresponding VQ codebook. Thus, if the output of a zero-input response filter 19 in the transmitter (FIG. 1*a*) is held or stored so at each step of computing the VQ code index (to transmit for each vector of a frame), it is possible to simplify encoding the speech vectors by subtracting the zero-state response output from the vector $f_n$. In other words, assuming $M=128$, there are 128 different vectors permanently stored in the VQ codebook to use in coding the original speech vectors $s_n$. Then every one of the 128 VQ vectors is read out in sequence, fed through the scaling unit 17', the LPC synthesis filter 15', and the perceptual weighting filter 18' shown in FIG. 2 without any history of previous vector inputs (ie., without any ringing due to excitation by a preceding vector) by resetting those filters at each step. The resulting filter output vector is then stored in a corresponding location in the zero-state response codebook 14. Later, while encoding input signal vectors $s_n$ by finding the best match between a vector $v_n$ and all of the zero state response vector codes, it is necessary to subtract from a vector $f_n$ derived from the perceptual weighting filter a value that corresponds to the effect of the previously selected VQ vector. That is done through the zero-input response filter 19. The index (address) of the best match is used as the compressed vector code transmitted for the vector $s_n$. Of the 128 zero-state response vectors, there will be only one that provides the best match, i.e., least distortion. Assume it is in location 38 of the zero-state response codebook as determined by a computer 20 labeled "compute norm." An address register **20*a* will store the index 38**. It is that index that is then transmitted as a VQ index to the receiver shown in FIG. 1*b*.

In the receiver, a demultiplexer 21 separates the side information which conditions the receiver with the same parameters as corresponding filters and scaling unit of the transmitter. The receiver uses a decoder 22 to translate the parameter indices to parameter values. The VQ index for each successive vector in the frame addresses a VQ codebook 23 which is identical to the fixed VQ codebook 13 of the transmitter. The LPC synthesis filter 24, pitch synthesis filter 25, and scaling unit 26 are conditioned by the same parameters which were used in computing the zero-state codebook values, and which were in turn used in the process of selecting the encoding index for each input vector. At each step of finding and transmitting an encoding index, the zero-input response filter 19 computes from the VQ vector at the location of the index transmitted a value to be subtracted from the input vector $f_n$ to present a zero-input response to be used in the best-match search.

There are various procedures that may be used to determine the best match for an input vector $s_n$. The simplest is to store the resulting distortion between each zero-state response vectorcode output and the vector $v_n$ with the index of that zero-state response vector code. Assuming there are 128 vectorcodes stored in the codebook 14, there would then be 128 resulting distortions stored in a computer 20. Then, after all have been stored, a search is made in the computer 20 for the lowest distortion value). Its index (address) of that lowest distortion value is then stored in a register 20*a* and transmitted to the receiver as an encoded vector via the multiplexer 12, and to the VQ codebook for reading the corresponding VQ vector to be used in the processing of the next input vector $s_n$.

In summary, it should be noted that the VQ codebook is used (accessed) in two different steps: first, to compute vector codes for the zero-state response codebook at the beginning of each frame, using the LPC synthesis and perceptual weighting filter parameters determined for the frame: and second, to excite the filters 15 and 16 through the scaling unit 17 while searching for the index of the bestmatch vector, during which the estimate $\hat{s}_n$ thus produced is subtracted from the input vector $s_n$. The difference $d_n$ is used in the best-match search.

As the best match for each input vector $s_n$ is found, the corresponding predetermined and fixed vector from the VQ codebook is used to reset the zero input response filter 19 for the next vector of the frame. The function of the zero-input response filter 19 is thus to find the residual response of the gain scaling unit 17' and filters 15' and 18' to previously selected vectors from the VQ codebook. Thus, the selected vector is not transmitted: only is used to read out the selected vector from a VQ codebook 23 identical to the VQ codebook 13 in the transmitter.

The zero-input response filter 19 is the same filtering operation that is used to generate the ZSR codebook 14, namely the combination of a gain G, an LPC synthesis filter and a weighting filter, as shown in FIG. 2. Once a best codebook vector match is determined, the best-match vector is applied as an input to this filter (sample by sample, sequentially). An input switch $s_{in}$ is closed and an output switch $s_{out}$ is open during this time so that the first K output samples are ignored (K is the dimension of the vector and a typical value of K is 20.) As soon as all K samples have been applied as inputs to the filter, the filter input switch $s_{in}$ is opened and the output switch $s_{out}$ is closed. The next K samples of the vector $f_n$, the output of the perceptual weighting filter, begin to arrive and are subtracted from the samples of the vector $f_n$. The difference so generated is a set of K samples forming the vector $v_n$ which is stored in a static register for use in the ZSR codebook search procedure. In the ZSR codebook search procedure, the vector $v_n$ is subtracted from each vector stored in the ZSR codebook, and the difference vector A is fed to the computer 20 together with the index (or stored in the same order, thereby to imply the index of the vector out of the ZSR codebook). The computer 20 then determines which difference is the smallest, i.e., which is the best match between the vector $v_n$ and each vector stored temporarily (for one frame of input vectors $s_n$). The index of that best-match vector is stored in a register 20*a*. That index is transmitted as a vectorcode and used to address the VQ codebook to read the vector stored there into the scaling unit 17, as noted above. This search process is repeated for each vector in the ZSR codebook, each time using the same vector $v_n$. Then the best vector is determined.

Figure 1B:
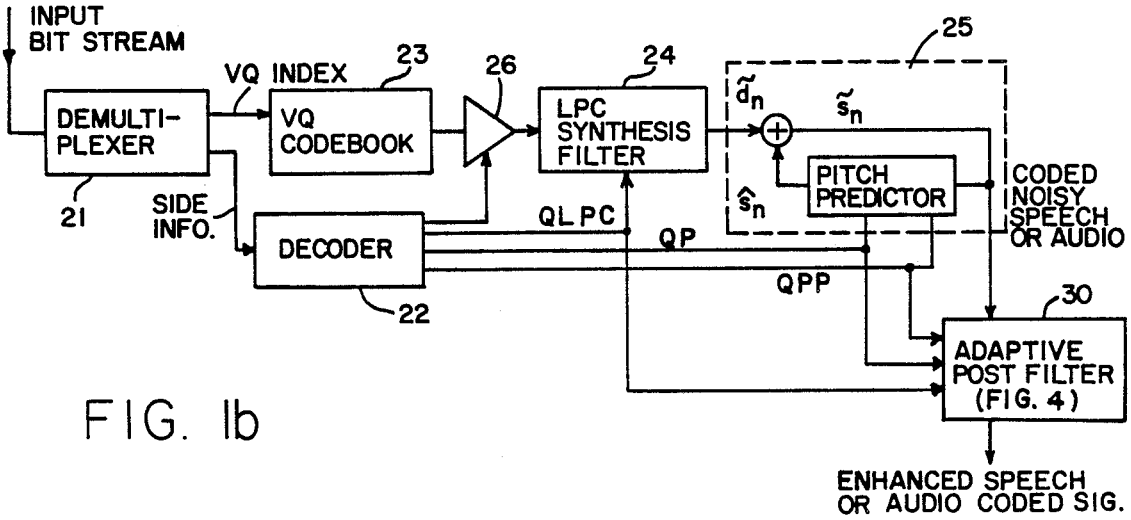
FIG. 1*b* is a block diagram of a receiver for the encoded speech transmitted by the system of FIG. 1*a*.

Referring now to FIG. 1*b*, it should be noted that the output of the VQ codebook 23, which precisely duplicates the VQ codebook 13 of the transmitter, is identical to the vector extracted from the best-match index applied as an address to the VQ codebook 13: the gain unit 26 is identical to the gain unit 17 in the transmitter, and filters 24 and 25 exactly duplicate the filters 15 and 16, respectively, except that at the receiver, the approximation $\hat{s}_n$ rather than the prediction $\hat{s}_n$ is taken as the output of the pitch synthesis filter 25. The result, after converting from digital to analog form, is synthesized speech that reproduces the original speech with very good quality.

Figure 4:
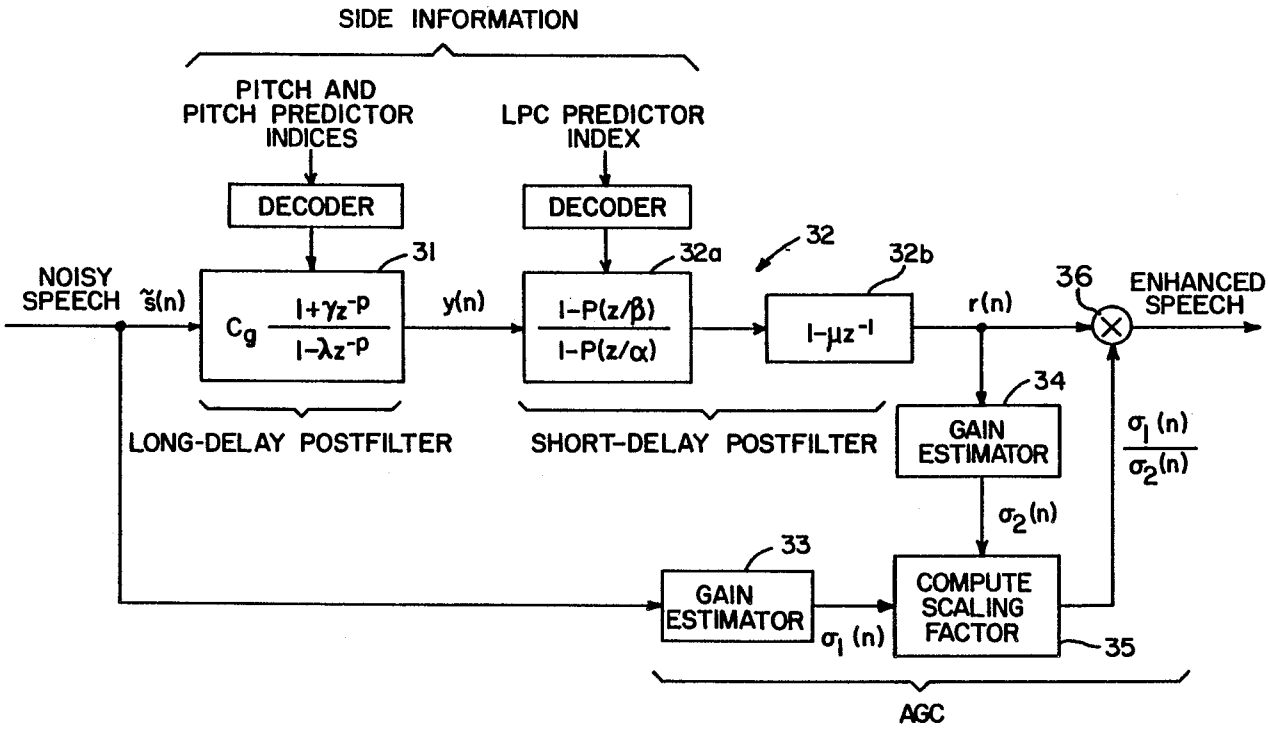
FIG. 4 is a block diagram of an adaptive post filter of FIG: 1*b*.

It has been found that by applying an adaptive postfilter 30 to the synthesized speech before converting it from digital to analog form, the perceived coding noise may be greatly reduced without introducing significant distortion in the filtered speech. FIG. 4 illustrates the organization of the adaptive postfilter as a long-delay filter 31 and a short-delay filter 32. Both filters are adaptive in that the parameters used in them are those received as side information from the transmitter, except for the gain parameter, G. The basic idea of adaptive post-filtering is to attenuate the frequency components of the coded speech in spectral valley regions. At low bit rates, a considerable amount of perceived coding noise comes from spectral valley regions where there are no strong resonances to mask the noise. The postfilter attenuates the noise components in spectral valley regions to make the coding noise less perceivable. However, such filtering operation inevitably introduces some distortion to the shape of the speech spectrum. Fortunately, our ears are not very sensitive to distortion in spectral valley regions: therefore, adaptive postfiltering only introduces very slight distortion in perceived speech, but it significantly reduces the perceived noise level. The adaptive postfilter will be described in greater detail after first describing in more detail the analysis of a frame of vectors to determine the side information.

Figure 3:
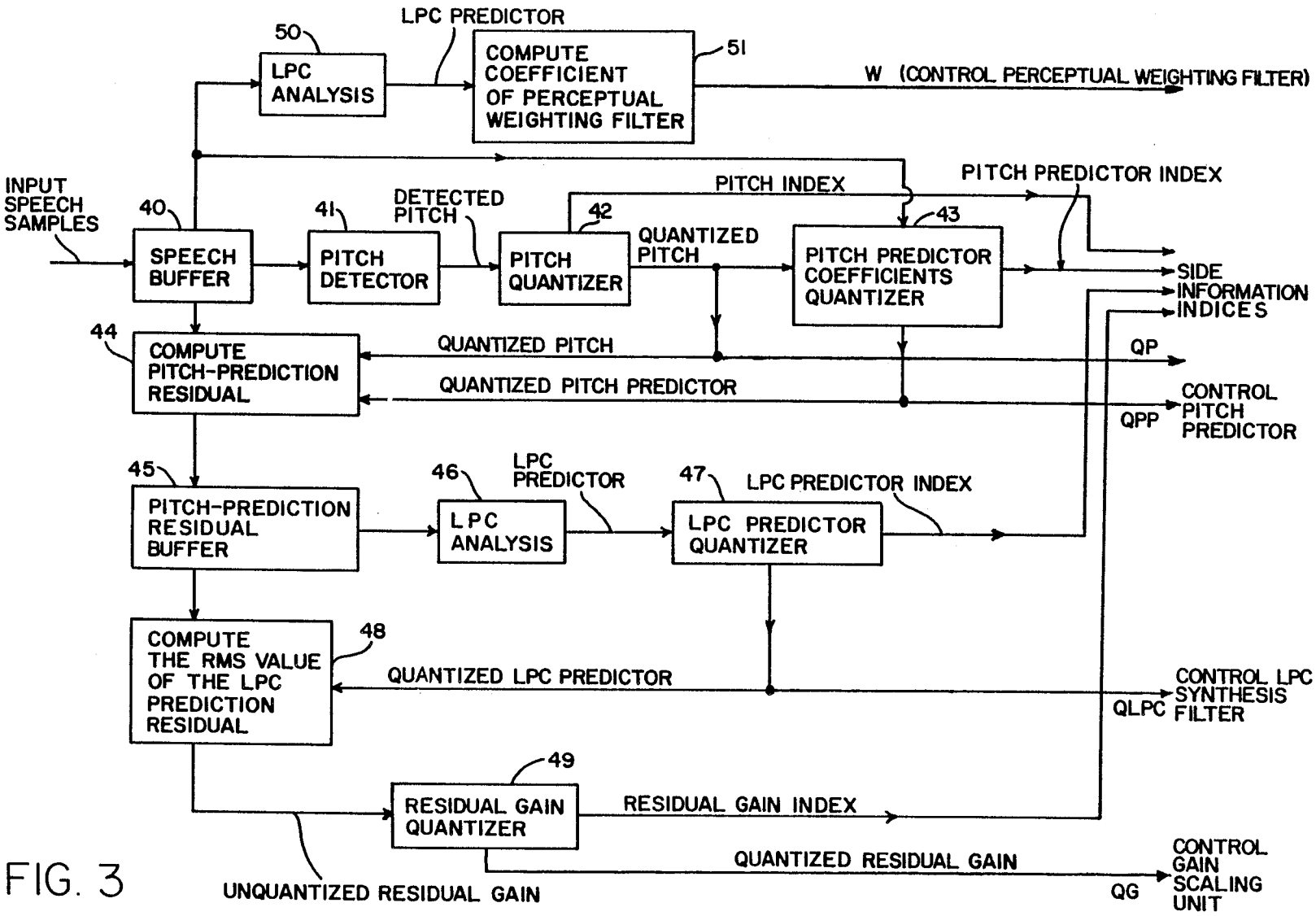
FIG. 3 is a block diagram of an analysis processor in the system of FIG. 1*a*.

Referring now to FIG. 3, it shows the organization of the initial analysis of block 11 in FIG.. 1*a*. The input speech samples $s_n$ are first stored in a buffer 40 capable of storing, for example, more than one frame of 8 vectors, each vector having 20 samples.

Once a frame of input vectors $s_n$ has been stored, the parameters to be used, and their indices to be transmitted as side information, are determined from that frame and at least a part of the previous frame in order to perform analysis with information from more than the frame of interest. The analysis is carried out as shown using a pitch detector 41, pitch quantizer 42 and a pitch predictor coefficient quantizer 43. What is referred to as "pitch" applies to any observed periodicity in the input signal, which may not necessarily correspond to the classical use of "pitch" corresponding to vibrations in the human vocal folds. The direct output of the speech is also used in the pitch predictor coefficient quantizer 43. The quantized pitch (QP) and quantized pitch predictor (QPP) are used to compute a pitch. prediction residual in block 44, and as control parameters for the pitch synthesis filter 16 used as a predictor in FIG. 1*a*. Only a pitch index and a pitch prediction index are included in the side information to minimize the number of bits transmitted. At the receiver, the decoder 22 will use each index to produce the corresponding control parameters for the pitch synthesis filter 25.

The pitch-prediction residual is stored in a buffer 45 for LPC analysis in block 46. The LPC predictor from the LPC analysis is quantized in block 47. The index of the quantized LPC predictor is transmitted as a third one of four pieces of side information, while the quantized LPC predictor is used as a parameter for control of the LPC synthesis filter 15, and in block 48 to compute the rms value of the LPC predictive residual. This value (unquantized residual gain) is then quantized in block 49 to provide gain control G in the scaling unit 17 of FIG. 1*a*. The index of the quantized residual gain is the fourth part of the side information transmitted.

In addition to the foregoing, the analysis section provides LPC analysis in block 50 to produce an LPC predictor from which the set of parameters W for the perceptual weighting filter 18 (FIG. 1*a*) is computed in block 51.

The adaptive postfilter 30 in FIG. 1*b* will now be described with reference to FIG. 4. It consists of a long-delay filter 31 and a short-delay filter 32 in cascade. The long-delay filter is derived from the decoded pitch-predictor information available at the receiver. It attenuates frequency components between pitch harmonic frequencies. The short-delay filter is derived from LPC predictor information, and it attenuates the frequency components between formant frequencies.

The noise masking effect of human auditory perception, recognized by M. R. Schroeder, B. S. Atal, and J. L. Hall, "Optimizing Digital Speech Coders by Exploiting Masking Properties of the Human Ear," J. Acoust. Soc. Am., Vol. 66, No. 6, pp. 1647–1652, December 1979, is exploited in VAPC by using noise spectral shaping. However, in noise spectral shaping, lowering noise components at certain frequencies can only be achieved at the price of increased noise components at other frequencies. [B. S. Atal and M. R. Schroeder, "Predictive Coding of Speech Signals and Subjective Error Criteria," IEEE Trans. Acoust., Speech, and Signal Processing, Vol. ASSP-27, No. 3, pp. 247–254, June 1979]Therefore, at bit rates as low as 4800 bps, where the average noise level is quite high, it is very difficult, if not impossible, to force noise below the masking threshold at all frequencies. Since speech formants are much more important to perception than spectral valleys, the approach of the present invention is to preserve the formant information by keeping the noise in the formant regions as low as is practical during encoding. Of course, in this case, the noise components in spectral valleys may exceed the threshold; however, these noise components can be attenuated later by the postfilter 30. In performing such postfiltering, the speech components in spectral valleys will also be attenuated. Fortunately, the limen, or "just noticeable difference," for the intensity of spectral valleys can be quite large [J. L. Flanagan, Speech Analysis, Synthesis, and Perception, Academic Press, New York, 1972]. Therefore, by attenuating the components in spectral valleys, the postfilter only introduces minimal distortion in the speech signal, but it achieves a substantial noise reduction.

Adaptive postfiltering has been used successfully in enhancing ADPCM-coded speech. See V. Ramamoorthy and J. S. Jayant, "Enhancement of ADPCM Speech by Adaptive Postfiltering," AT&T Bell Labs Tech. J., pp. 1465–1475, October 1984: and N. S. Jayant and V. Ramamoorthy, "Adaptive Postfiltering of 16 kb/s-ADPCM Speech," Proc. ICASSP, pp. 829–832, Tokyo, Japan, April 1986. The postfilter used by Ramamoorthy, et al., supra, is derived from the two-pole six-zero ADPCM synthesis filter by moving the poles and zeros radially toward the origin. If this idea is extended directly to an all-pole LPC synthesis filter $1/[1-\hat{P}(z)]$, the result is $I/[1-\hat{P}(z/\alpha)]$ as the corresponding postfilter, where $0<\alpha<1$. Such an all-pole postfilter indeed reduces the perceived noise level: however, sufficient noise reduction can only be achieved with severe muffling in the filtered speech. This is due to the fact that the frequency response of this all-pole postfilter generally has a lowpass spectral tilt for voiced speech.

The spectral tilt of the all-pole postfilter $1/[1-\hat{P}(z/\alpha)]$ can be easily reduced by adding zeros having the same phase angles as the poles but with smaller radii. The transfer function of the resulting pole-zero postfilter 32*a* has the form $$H(z) = \frac{1-\hat{P}(z/\beta)}{1-\hat{P}(z/\alpha)}, \quad 0<\beta<\alpha<1 \tag{1}$$

where $\alpha$ and $\beta$ are coefficients empirically determined, with some tradeoff between spectral peaks being so sharp as to produce chirping and being so low as to not achieve any noise reduction. The frequency response of H(z) can be expressed as $$20\log|H(e^{jw})| = 20\log\frac{1}{|1-\hat{P}(e^{jw}/\alpha)|} - 20\log\frac{1}{|1-\hat{P}(e^{jw}/\beta)|} \tag{2}$$

Therefore, in logarithmic scale, the frequency response of the pole-zero postfilter H(z) is simply the difference between the frequency responses of two all-pole postfilters.

Figure 5:
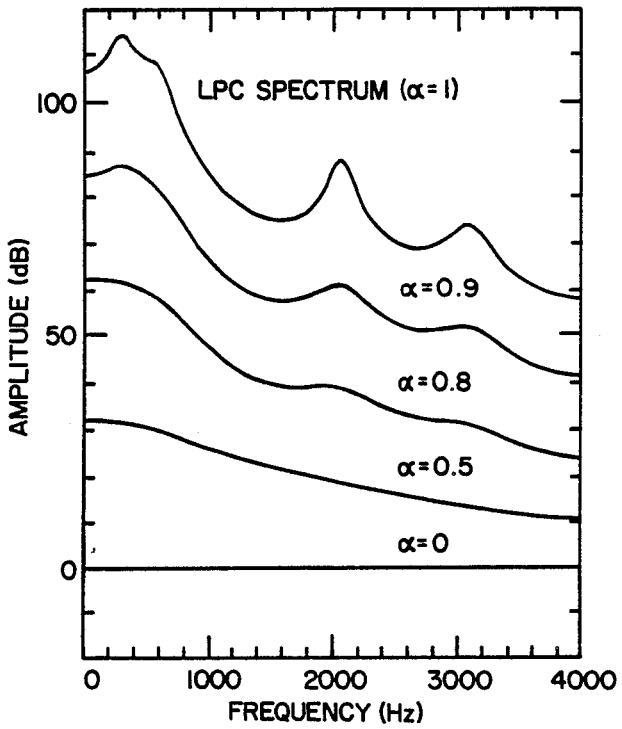
FIG. 5 illustrates the LPC spectrum and the corresponding frequency response of an all-pole post-filter $1/[\hat{1}-P(z/\alpha)]$ for different values of $\alpha$. The offset between adjacent plots is 20 dB.
Figure 6:
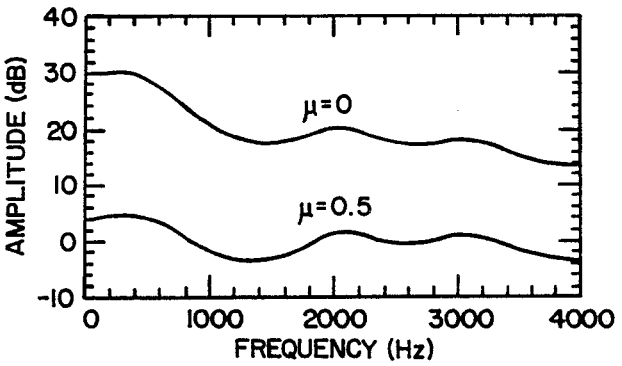
FIG. 6 illustrates the frequency responses of the post-filter $[1-\mu z^{-1}][1-\hat{P}(z/\beta)]/[1-\hat{P}(z/\alpha)]$ corresponding to the LPC spectrum shown in FIG. 5. In both plots, $\alpha=0.8$ and $\beta=0.5$. The offset between the two plots is 20 dB.

Typical values of $\alpha$ and $\beta$ are 0.8 and 0.5, respectively. From FIG. 5, it is seen that the response for $\alpha=0.8$ has both formant peaks and spectral tilt, while the response for $\alpha=0.5$ has spectral tilt only. Thus, with $\alpha=0.8$ and $\beta=0.5$ in Equation 2, we can at least partially remove the spectral tilt by subtracting the response for $\alpha=0.5$ from the response for $\alpha=0.8$. The resulting frequency response of H(z) is shown in the upper plot of FIG. 6

In informal listening tests, it has been found that the muffling effect was significantly reduced after the numerator term $[1-\hat{P}(z/\beta)]$ was included in the transfer function H(z) However, the filtered speech remained slightly muffled even with the spectral-tilt compensating term $[1-\hat{P}(z/\beta)]$. To further reduce the muffling effect, a first-order filter 32*b* was added which has a transfer function of $[1-\mu z^{-1}]$, where $\mu$ is typically 0.5. Such a filter provides a slightly highpassed spectral tilt and thus helps to reduce muffling This first-order filter is used in cascade with H(z), and a combined frequency response with $\mu=0.5$ is shown in the lower plot of FIG. 6.

The short-delay postfilter 32 just described basically amplifies speech formants and attenuates inter-formant valleys To obtain the ideal postfilter frequency response, we also have to amplify the pitch harmonics and attenuate the valleys between harmonics. Such a characteristic of frequency response can be achieved with a long-delay postfilter using the information in the pitch predictor.

In VAPC, we use a three-tap pitch predictor: the pitch synthesis filter corresponding to such a pitch predictor is not guaranteed to be stable. Since the poles of such a synthesis filter may be outside the unit circle, moving the poles toward the origin may not have the same effect as in a stable LPC synthesis filter. Even if the three-tap pitch synthesis filter is stabilized, its frequency response may have an undesirable spectral tilt. Thus, it is not suitable to obtain the long-delay postfilter by scaling down the three tap weights of the pitch synthesis filter.

With both poles and zeroes, the long-delay postfilter can be chosen as $$H_1(z) = C_g \frac{1 + \gamma z^{-p}}{1 - \lambda z^{-p}} \tag{3}$$

where p is determined by pitch analysis, and $C_g$ is an adaptive scaling factor.

Knowing the information provided by a single or three-tap pitch predictor as the value $b_2$ or the sum of $b_1=b_2+b_3$, the factors Y and $\gamma$ are determined according to the following formulas:

$$\gamma = C_z f(x),\ \lambda = C_p f(x),\ 0 < C_z, C_p < 1 \tag{4}$$

where $$f(x) = \begin{cases} 1 \text{ if } x > 1 \\ x \text{ if } U_{th} \leqq x \leqq 1 \\ 0 \text{ if } x < U_{th} \end{cases} \tag{5}$$

where where $U_{th}$ is a threshold value (typically 0.6) determined empirically, and x can be either $b_2$ or $b_1+b_2+b_3$ depending on whether a one-tap or a three-tap pitch predictor is used. Since a quantized three-tap pitch predictor is preferred and therefore already available at the VAPC receiver, x is chosen as $$\sum_{i=1}^{3} b_i,$$

in VAPC postfiltering. On the other hand, if the postfilter is used elsewhere to enhance noisy input speech, a separate pitch analysis is needed, and x may be chosen as a single value $b_2$ since a one-tap pitch predictor suffices. (The value $b_2$ when used alone indicates a value from a single-tap predictor, which in practice would be the same as a three-tap predictor when $b_1$ and $b_3$ are set to zero.)

The goal is to make the power of {y(n)} about the same as that of {s(n)}. An appropriate scaling factor is chosen as $$C_g = \frac{1 - \lambda/x}{1 + \gamma/x} \tag{6}$$

The first-order filter **32*b*** can also be made adaptive to better track the change in the spectral tilt of H(z). However, it has been found that even a fixed filter with $\mu=0.5$ gives quite satisfactory results. A fixed value of $\mu$ may be determined empirically.

To avoid occasional large gain excursions, an automatic gain control (AGC) was added at the output of the adaptive postfilter. The purpose of AGC is to scale the enhanced speech such that it has roughly the same power as the unfiltered noisy speech. It is comprised of a gain (square root of power) estimator 33 operating on the speech input $s_r$, a gain (square root of power) estimator 34 operating on the postfiltered output r(n), and a circuit 35 to compute a scaling factor as the ratios of the two gains. The postfiltering output r(n) is then multiplied by this ratio in a multiplier 36. AGC is thus achieved by estimating thee square root of the power of the unfiltered and filtered speech separately and then using the ratio of the two values as the scaling factor. Let {s(n)} be the sequence of either unfiltered or filtered speech samples: then, the speech power $\sigma^2(n)$ is estimated by using $$\sigma^2(n)=\zeta\sigma^2(n-1)+(1-\zeta)s^2(n),\ 0<\zeta<1. \tag{7}$$

A suitable value of $\zeta$ is 0.99.

The complexity of the postfilter described in this section is only a small fraction of the overall complexity of the rest of the VAPC system, or any other coding system that may be used. In simulations, this postfilter achieves significant noise reduction with almost negligible distortion in speech. To test for possible distorting effects, the adaptive postfiltering operation was applied to clean, uncoded speech and it was found that the unfiltered original and its filtered version sound essentially the same, indicating that the distortion introduced by this postfilter is negligible.

It should be noted that although this novel postfiltering technique was developed for use with the present invention, its applications are not restricted to use with it. In fact, this technique can be used not only to enhance the quality of any noisy digital speech signal but also to enhance the decoded speech of other speech coders when provided with a buffer and analysis section for determining the parameters.

What has been disclosed is a real-time Vector Adaptive Predictive Coder (VAPC) for speech or audio which may be implemented with software using the commercially available AT&T DSP32 digital processing chip. In its newest version, this chip has a processing power of 6 million instructions per second (MIPS). To facilitate implementation for real-time speech coding, a simplified version of the 4800 bps VAPC is available. This simplified version has a much lower complexity, but gives nearly the same speech quality as a full complexity version.

In the real-time implementation, an innerproduct approach is used for computing the norm (smallest distortion) which is more efficient than the conventional difference-square approach of computing the mean square error (MSE) distortion. Given a test vector v and M ZSR codebook vectors, $z_j$, j=1,2, . . ., M, the j-th MSE distortion can be computed as $$\| v - z_j \|^2 = \| v \|^2 - 2 [v^T z_j - \tfrac{1}{2} \| z_j \|^2] \quad (8)$$

At the beginning of each frame, it is possible to compute and store $\frac{1}{2} \| Z_j \|^2$. With the DSP32 processor and for the dimension and codebook size used, the difference-square approach of the codebook search requires about 2.5 MIPS to implement, while the inner-product approach only requires about 1.5 MIPS.

The complexity of the VAPC is only about 3 million multiply-adds/second and 6 k words of data memory. However, due to the overhead in implementation, a single DSP32 chip was not sufficient for implementing the coder. Therefore, two DSP32 chips were used to implement the VAPC. With a faster DSP32 chip now available, which has an instruction cycle time of 160 ns rather than 250 ns, it is expected that the VAPC can be implemented using only one DSP32 chip.

What is claimed is:

1. An improvement in the method for compressing digitally encoded input speech or audio vectors at a transmitter by using a scaling unit controlled by a quantized residual gain factor QG, a synthesis filter controlled by a set of quantized linear protective coefficient parameters QLPC, a pitch predictor controlled by pitch and pitch predictor parameters QP and QPP, a weighting filter controlled by a set of perceptual weighting parameters W, and a permanent indexed codebook containing a predetermined number M of codebook vectors, each having an assigned codebook index, to find an index which identifies the best match between an input speech or audio vector $s_n$ that is to be coded and a synthesized vector $\tilde{s}_n$ generated from a stored vector in said indexed codebook, wherein each of said digitally encoded input vectors consists of a predetermined number K of digitally coded samples, comprising the steps of buffering and grouping said input speech or audio vectors into frames of vectors with a predetermined number N of vectors in each frame, performing an initial analysis for each successive frame, said analysis including the computation of a residual gain factor G, a set of perceptual weighting parameters W, a pitch parameter P, a pitch predictor parameter PP, and a set of said linear predictive coefficient parameters LPC, and the computation of quantized values QG, QP, QPP and QLPC of parameters G, P, PP and LPC using one or more indexed quantizing tables for the computation of each quantized parameter or set of parameters for each frame transmitting indices of said quantized parameters QG, QP, QPP and QLPC determined in the initial analysis step as side information about vectors analyzed for later use in looking up in one or more identical tables said quantized parameters QG, QP QPP and QLPC while reconstructing speech and audio vectors from encoded vectors in a frame, where each index for a quantized parameter points to a location in one or more of said identical tables where said quantized parameter may be found, computing a zero-state response vector from the vector output of a zero-input response filter comprising a scaling unit, synthesis filter and weighting filter identical in operation to said scaling unit, synthesis filter and weighting filter used for encoding said input vectors, said zero-state response vector being computed for each vector in said permanent codebook by first setting to zero the initial condition of said zero-input response filter so that the response computed is not influenced by a preceding one of said codebook vectors processed by said zero-input response filter, and the using said quanitized values of said residual gain factor, set of linear predictive coefficient parameters, and said set of perceptual weighting parameters computed in said initial analysis step by processing each vector in said permanent codebook through said zero-input response filter to compute a zero-state response vector, and storing each zero-state response vector computed in a zero-state response codebook at or together with an index corresponding to the index of said vector in said permanent codebook used for this zero-state response computation step, and after thus performing an initial analysis of and computing a zero-state response codebook for each successive frame of input speech or audio vectors, encode each input vector $s_n$ of a frame in sequence by transmitting the codebook index of the vector in said permanent codebook which corresponds to the index of a zero-state response vector in said zero-state response codebook that best matches a vector $v_n$ obtained from an input vector $s_n$ by subtracting a long term pitch prediction vector $\hat{s}_n$ from the input vector $s_n$ to produce a difference vector $d_n$ and filtering said difference vector $\tilde{d}_n$ by said perceptual weighting filter to produce a final input vector $f_n$, where said long term pitch prediction $\hat{s}_n$ is computed by taking a vector from said permanent codebook at the address specified by the preceding particular index transmitted as a compressed vector code and performing gain scaling of this vector using said quantized gain factor QG, then synthesis filtering the vector obtained from said scaling using said quantized values QLPC of said set of linear predictive coefficient parameters to obtain a vector $\tilde{d}_n$ and from vector $\tilde{d}_n$ producing a long term pitch predicted vector $\hat{s}_n$ of the next input vector $s_n$ through a pitch synthesis filter using said quantized values of pitch predictor parameters QP and QPP, said long term prediction vector $\hat{s}_n$ being a prediction of the next input vector $s_n$, and producing said vector $v_n$ by subtracting from said final input vector $f_n$ the vector output of said zero-input response filter generated in response to a permanent codebook vector at the codebook address of the last transmitted index code, said vector output being generated by processing through said zero input response filter, said permanent codebook vector located at said last transmitted index code where the output of said zero input response filter is discarded while said permanent codebook vector located at said last transmitted index code is being processed sample by sample in sequence into said zero input response filter until all samples of said codebook vector have been entered, and where the input of said zero input response filter is interrupted after all samples of said codebook vector have been entered and then the desired vector output from said zero-input response filter is processed out sample by sample for subtraction from said final vector $v_n$, and for each input vector $s_n$ in a frame, finding the vector stored in said zero-state response codebook which best matches the vector $v_n$, thereby finding the best match of a codebook vector with an input vector, using an estimate vector $\hat{s}_n$ produced from the best match codebook vector found for the preceding input vector, having found the best match of said vector $v_n$ with a zero-state response vector in said zero-state response codebook for an input speech or audio vector $s_n$, transmit the zero-state response codebook index of the current best-match zero-state response vector as a compressed vector code of the current input vector, and also use said index of the current best-match zero-state response vector to select a vector from said permanent codebook for computing said long term pitch predicted input vector $\hat{s}_n$ to be subtracted from the next input vector $s_n$ of the frame.

2. An improvement as defined in claim 1, including a method for reconstructing said input speech or audio vectors from index coded vectors at a receiver, comprised of decoding said side information transmitted for each frame of index coded vectors, using the indices received to address a permanent codebook identical to said permanent codebook in said transmitter to successively obtain decoded vectors, scaling said decoded vectors by said quantized gain factor QG, and performing synthesis filtering using said set of linear predictive coefficient parameters and pitch prediction filtering using said quantized pitch parameters QP and QPP to produce approximation vectors $\hat{s}_n$ of the original signal vectors $s_n$.

3. An improvement as defined in claim 2 wherein said receiver includes postfiltering of said approximation vectors $\tilde{s}_n$ by long-delay postfiltering and short-delay postfiltering in cascade, said quantized pitch and quantized pitch predictor parameters controlling said long-term postfiltering and said quantized linear predictive coefficient parameters controlling said short-term postfiltering, whereby adaptive postfiltered digitally encoded speech or audio vectors are provided.

4. An improvement as defined in claim 3 including automatic gain control of the adaptive postfiltered digitally encoded speech or audio signal is provided by estimating the square root of the power of said postfiltered speech or audio signal to obtain a value $\sigma_a(n)$ of said postfiltered speech or audio signal and estimating the square root of the power of a postfiltering speech or audio signal input to obtain a value $\sigma_1(n)$ of decoded input speech or audio vectors before postfiltering, and controlling the gain of the postfiltered speech or audio output signal by a scaling factor that is a ratio of $\sigma_1(n)$ to $\sigma_2(n)$.

5. An improvement as defined in claim 4 wherein said quantized gain factor, quantized pitch and quantized pitch predictor parameters, and quantized linear predictive coefficient parameters are derived from said side information transmitted to said receiver.

6. An improvement as defined in claim 3 wherein postfiltering is accomplished by using a transfer function for said long-delay postfilter of the form $$C_g = \frac{1 + \gamma z^{-p}}{1 - \lambda z^{-p}} = \frac{1 - \lambda/x}{1 + \gamma/x}$$

where $C_g$ is an adaptive scaling factor, p is the quantized value QP of the pitch parameter P, and the factors $\gamma$ and $\lambda$ are determined according to the following formulas $$\gamma = C_z(x),\ \lambda = C_p f(x),\ 0 < C_z,\ C_p < 1$$

where $C_z$ and $C_p$ are fixed scaling factors, $$f(x) = \begin{cases} 1 \text{ if } x > 1 \\ x \text{ if } U_{th} \leqq x \leqq 1 \\ 0 \text{ if } x < U_{th} \end{cases}$$

$U_{th}$ is an unvoiced threshold value, and x is a voicing indicator parameter that is a function of coefficients $b_1$, $b_2$ and $b_3$, where $b_1$, $b_2$, $b_3$ are coefficients of said quantized pitch predictor QPP given by $P_1(z) = 1 - b_1 z^{-p+1} - b_2 z^{-p} - b_3 z^{-p-1}$ where z is the inverse of the input delay operator $z^{-1}$ used in the z transform representation of transfer functions.

7. An improvement as defined in claim 6 wherein postfiltering is accomplished by using a transfer function for said short-delay postfilter of the form $$\frac{1 - P(z/\beta)}{1 - P(z/\alpha)},\ 0 < \beta < \alpha < 1$$

where $\alpha$ and $\beta$ are bandwidth expansion coefficients.

8. An improvement as defined in claim 7 wherein postfiltering further includes in cascade first-order filtering with a transfer function $$1 - \mu z^{-1},\ \mu < 1$$

where $\mu$ is a coefficient.

9. A postfiltering method for enhancing digitally processed speech or audio signals comprising the steps of buffering said speech or audio signals into frames of vectors, each vector having K successive samples, performing analysis of said buffered frames of speech or audio signals in predetermined blocks to compute linear predictive coefficients, pitch and pitch predictor parameters, and filtering each vector with long-delay and short-delay postfiltering in cascade, said long-delay postfiltering being controlled by said pitch and pitch predictor parameters and said short-delay postfiltering being controlled by said linear predictive coefficient parameters, wherein postfiltering is accomplished by using a transfer function for said short-delay postfilter of the form $$\frac{1 - P(z/\beta)}{1 - P(z/\alpha)},\ 0 < \beta < \alpha < 1$$

where z is the inverse of the unit delay operator $z^{-1}$ used in the z transform representation of transfer functions, and $\alpha$ and $\beta$ are fixed scaling factors.

10. A postfiltering method as defined in claim 9 including automatic gain control of the postfiltered digitally encoded speech or audio signal provided by estimating the square root of the power of said postfiltered digitally encoded speech or audio signal to obtain a value $\sigma_2(n)$ of said postfiltered speech signal and estimating the square root of the power of a postfiltering input speech or audio signal to obtain a value $\sigma_1(n)$ of decoded input speech or audio signal before postfiltering, and controlling the gain of the postfiltered speech or audio signal by a scaling factor that is a ratio of $\sigma_1(n)$ to $\sigma_2(n)$.

11. A postfiltering method as defined in claim 10 wherein postfiltering is accomplished by using a transfer function for said long-delay postfilter of the form $$C_g = \frac{1 + \gamma z^{-p}}{1 - \lambda z^{-p}}$$

where $C_g$ is an adaptive scaling factor, p is the quantized value of the pitch parameter QP and the factors $\gamma$ and $\lambda$ are adaptive bandwidth expansion parameters determined according to the following formulas $$\gamma = C_z f(x),\ \lambda = C_p f(x),\ 0 < C_z,\ C_p < 1$$

where $C_z$ and $C_p$ are fixed scaling factors and $$f(x) = \begin{cases} 1 \text{ if } x > 1 \\ x \text{ if } U_{th} \leqq x \leqq 1 \\ 0 \text{ if } x < U_{th} \end{cases}$$

$U_{th}$ is an unvoiced threshold value, and x is a voicing indicator that is a function of coefficients $b_1$, $b_2$, $b_3$ where $b_1$, $b_2$, $b_3$ are coefficients of said quantized pitch predictor QPP given by $P_1(z) = 1 - b_1 z^{-p+1} - b_2 z^{-p} - b_3 z^{-p-1}$ where z is the inverse of the input delay operator $z^{-1}$ used in the z transform representation of transfer functions.

12. A postfiltering method as defined in claim 11 wherein postfiltering further includes in cascade first-order filtering with a transfer function $$1 - \mu z^{-1},\ \mu < 1$$

where $\mu$ is a coefficient.

* * * * *

UNITED STATES PATENT AND TRADEMARK OFFICE

CERTIFICATE OF CORRECTION

PATENT NO. : 4,969,192
DATED : November 6, 1990
INVENTOR(S) : Juin-Hwey Chen and Allen Gersho It is certified that error appears in the above-indentified patent and that said Letters Patent is hereby corrected as shown below:

Column 1, line 26 delete "syntheticquality" and substitute -- synthetic quality --.

Column 2, line 3, delete "liner" and substitute -- linear --.

Column 3, line 36, delete "each in each" and substitute -- each --.

Column 3, line 37, delete "$s'_n$" and substitute -- $\hat{s}_n$ --.

Column 3, line 38, delete "last vector" and substitute -- previous vectors --.

Column 3, line 39, delete "as an index code" and substitute -- as index codes --.

Column 3, line 43, delete "a previous vector" and substitute -- previous vectors --.

Column 6, line 2, delete "AG" and substitute -- QG --.

Column 6, line 33, delete "zero-state" and substitute -- zero-input --.

Column 7, line 62, delete "and are" and substitute -- and the samples of the ZIR filter output are --.

Column 8, line 22, delete "$\hat{s}_n$" of first occurrence and substitute -- $\bar{s}_n$ --.

UNITED STATES PATENT AND TRADEMARK OFFICE

CERTIFICATE OF CORRECTION

PATENT NO. : 4,969,192
DATED : November 6, 1990
INVENTOR(S) : Juin-Hwey Chen and Allen Gersho It is certified that error appears in the above-indentified patent and that said Letters Patent is hereby corrected as shown below:

Column 10, line 17, delete "I" and substitute -- 1 --.

Column 10, line 62, after "H(z)" insert a period -- . --.

Column 11, line 35, delete "=" and substitute -- + --.

Column 11, line 35, delete "Y" and substitute -- $\lambda$ --.

Column 12, line 21, delete "thee" and substitute -- the --.

Column 14, line 31, delete "$\tilde{d}_n$" and substitute -- $d_n$ --.

Column 15, line 33, delete "$\hat{s}_n$" and substitute -- $\tilde{s}_n$ --.

UNITED STATES PATENT AND TRADEMARK OFFICE

CERTIFICATE OF CORRECTION

PATENT NO. : 4,969,192
DATED : November 6, 1990
INVENTOR(S) : Juin-Hwey Chen and Allen Gersho It is certified that error appears in the above-indentified patent and that said Letters Patent is hereby corrected as shown below:

Column 15, line 48, delete "$\sigma_a(n)$" and substitute -- $\sigma_2(n)$ --.

Column 15, line 65, delete the equation and substitute --

$$H_l(z) = C_g \frac{1+\gamma z^{-p}}{1-\lambda z^{-p}}, \quad C_g = \frac{1-\lambda/x}{1+\lambda/x}$$ --.

Column 16, line 5, delete the equation and substitute --

$$\gamma = C_z f(x), \ \lambda = C_p f(x), \ 0 < C_z, C_p < 1$$ --.

UNITED STATES PATENT AND TRADEMARK OFFICE

CERTIFICATE OF CORRECTION

PATENT NO. : 4,969,192

DATED : November 6, 1990

INVENTOR(S) : Juin-Hwey Chen, et. al.

It is certified that error appears in the above-indentified patent and that said Letters Patent is hereby corrected as shown below:

Column 17, line 18, delete the equation and substitute --

$$\gamma = C_z f(x),\ \lambda = C_p f(x),\ 0 < C_z,\ C_p < 1$$ --.

Signed and Sealed this

Seventh Day of March, 1995

Bruce Lehman

BRUCE LEHMAN

*Commissioner of Patents and Trademarks*

*Attest:*

*Attesting Officer*